United States Patent [19]

Whelan et al.

[11] 4,156,801

[45] May 29, 1979

[54] PATTERN VOICE COIL LOUDSPEAKER WITH BAFFLES TOUCHING DIAPHRAGM

[75] Inventors: Robert C. Whelan, Comberton; Charles J. Sealey, Gt. Wilbraham, both of England

[73] Assignee: Strathern Audio Limited, Belfast, Northern Ireland

[21] Appl. No.: 878,813

[22] Filed: Feb. 17, 1978

[30] Foreign Application Priority Data

Feb. 18, 1977 [GB] United Kingdom ..... 6909/77

[51] Int. Cl.[2] ..... H04R 9/06

[52] U.S. Cl. ..... 179/115.5 PV

[58] Field of Search ..... 179/115.5 PV

[56] References Cited

U.S. PATENT DOCUMENTS 3,898,598 8/1975 Asahi ..... 179/115.5 PV

*Primary Examiner*—George G. Stellar

*Attorney, Agent, or Firm*—Milton M. Field

[57] ABSTRACT

An electrodynamic loudspeaker has a diaphragm with a central driven area. Undriven areas of the diaphragm are baffled to minimize the effect of vibrations from the undriven areas which are out of phase with those in the central driven area.

3 Claims, 5 Drawing Figures

PATTERN VOICE COIL LOUDSPEAKER WITH BAFFLES TOUCHING DIAPHRAGM

This invention relates to electrodynamic loudspeakers. These possess diaphragms carrying over an area thereof a plurality of conductors, and this area is confronted on one or both sides by a closely similar area of magnet poles. A preferred arrangement has the conductors spatially parallel, uniformly spaced and uniformly fed in parallel by similarly directed currents, the magnets being parallel rows of, or parallel individual elongated, north pole pieces on one side and south pole pieces on the other. The areas concerned would typically be a generally central large minority of the total area of the diaphragm. The diaphragm in embodiments of the invention is rectangular, and the area is also rectangular, extending the whole of one dimension, the height of the diaphragm. In width there would be similar unenergized areas each side of the energized area.

The invention is not concerned with those electrodynamic loudspeakers in which substantially the whole of the diaphragm is energized, carrying conductors therefor. The invention aims at efficiency, coupled with reasonably uniform frequency response over a central audio range.

One aspect of the invention concerns improving the dimensions of the aperture through which such a diaphragm is acoustically coupled to the outside atmosphere. The aperture will typically be rectangular also, probably extending approximately the height and width of the area of conductors and confronting magnetic poles. The dimensions of the aperture affect low and high frequency cut-offs, sound dispersions at different frequencies, bandwidth, radiation energy efficiency and other parameters.

A second aspect of the invention proposes a respective baffle on each side of the pole pieces, and on each side of the radiation aperture. The effect is to minimize coupling of vibrations of these two non-driven (i.e., not directly driven) areas of the diaphragm, particularly at intermediate frequencies of the audio range. These areas will be indirectly driven by the electromagnetic driving of the conductor-bearing central area at low and intermediate frequencies arranged to be present.

At high frequencies, damping and stiffness arranged to be present in the outer sections of the diaphragm material will confine vibrations to the central area. At low frequencies the damping, stiffness and weight loading of the outer areas will not prevent their vibrating uniformly with, i.e., in phase with, the central driven area. At intermediate frequencies problems tend to arise because the outer areas vibrate in sympathy with, but not uniformly with, the inner area. Therefore the phase of vibrations varies over the diaphragm area, and sharp frequency response variations, efficiency fall-offs and unacceptable harmonic distortions occur. The baffles confine substantial energy coupling at the intermediate frequencies to the inner, directly driven diaphragm portion. However lower frequencies can be coupled out, without prejudice since such phase variations are of diminishing magnitudes.

Embodiments of the invention will now be described in conjunction with the drawings, in which.

Figure 4:
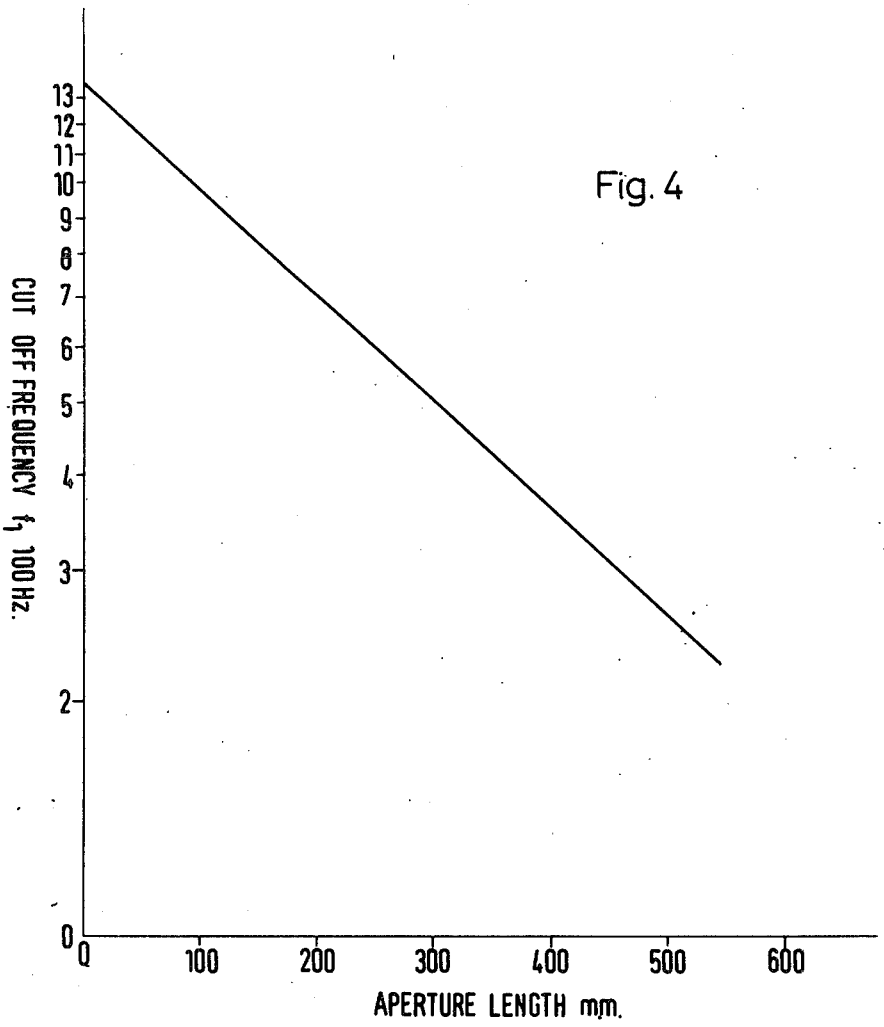
Figure 5:
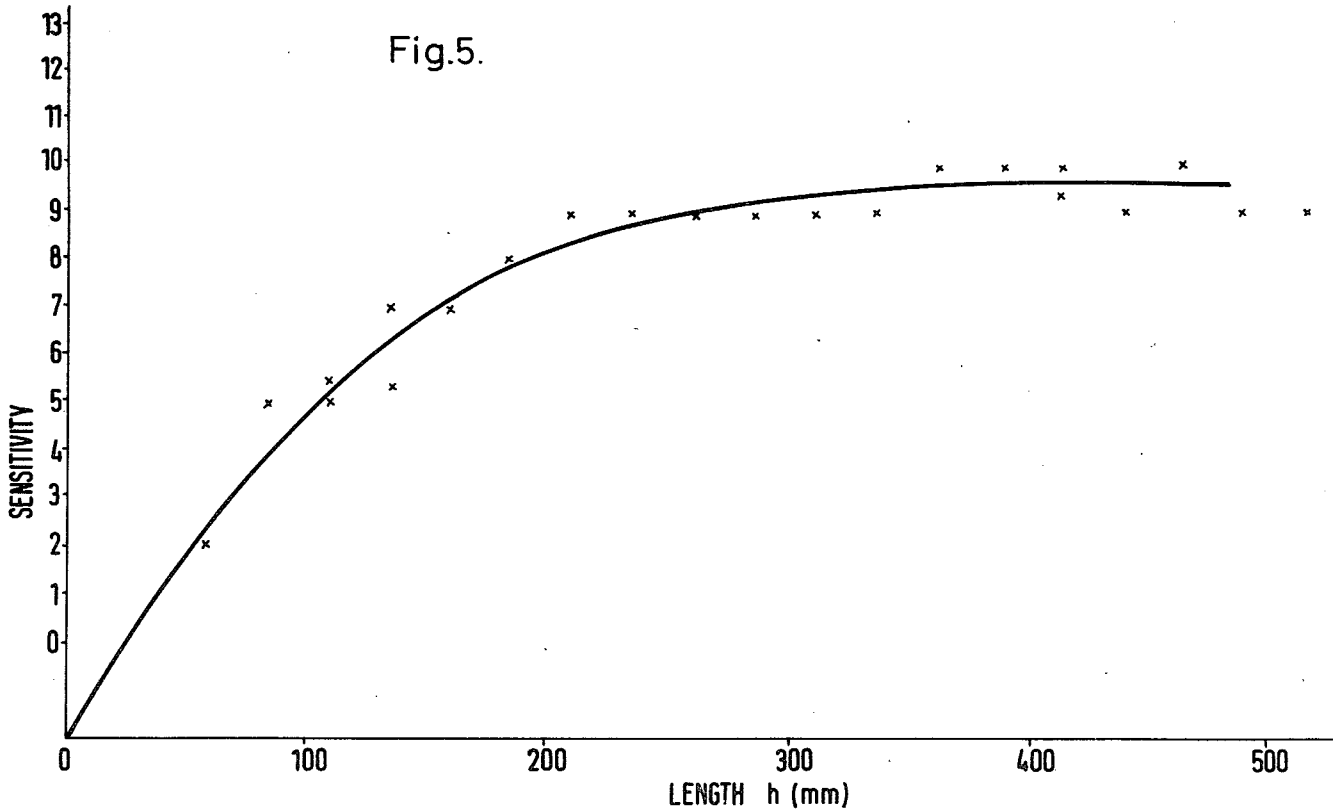

FIG. 4 graphs a typical relationship between radiating height (maximum dimension) and lowest available frequency of operation (low cutoff frequency), and FIG. 5 shows a graph of sensitivity and radiating height.

Figure 1:
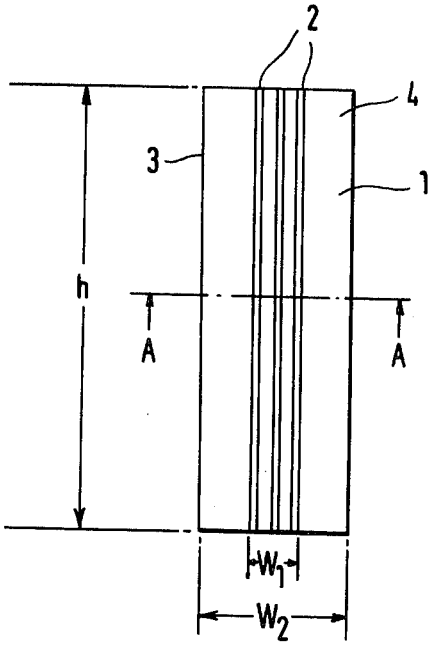
FIG. 1 shows a diaphragm in plan view, and the lines of confrontation thereof with linear magnetic pole pieces.

Referring to FIG. 1 a diaphragm 1 has its maximum dimension, subsequently referred to as length, in the height direction. Along the length and centrally are lines 2 of magnet confrontation, the lines 2 represent the directly electromagnetically driven area of the diaphragm. The outer areas 3, 4 also extending over the diaphragm length are vibrated indirectly, in sympathy with the central area, except at high frequencies, where hysteresis losses and inertia prevent their significant following of the driven central area. Conductors (not shown) are carried over the central diaphragm area in close proximity to the confronting magnets represented at 2. The central area 2 has the length h of the diaphragm, and width $w_1$ as shown. The diaphragm width is $w_2$.

There are a number of limitations with existing loudspeakers, namely lack of control of frequency response due to limited diaphragm technology those units with a smooth controlled frequency response appear unable to produce high acoustic output levels and to sustain overload drive conditions without experiencing damage lack of a smooth frequency response unless severe penalties are taken with efficiency.

In order to use the plane diaphragm in a loudspeaker it is necessary to consider the relationships which exist between acoustic output, bandwidth, geometric shape and physical size of the radiator. In addition the electromechanical performance of the motor which is used to drive the diaphragm also requires consideration. It was decided to use the electrodynamic motor system as applied to a plane radiator. Such systems have been proposed earlier by Siemens (Blatt-haller), Kelly (1954), Poutot (1961) and Gamzon et al. (1961) amongst others and some commercial examples exist, notably the "magnaplanar," the "Wharfedale Isodynamic" Headphone and the "Magnastat" by Cerwin Vega.

The design and construction of a loudspeaker unit is constrained by a number of parameters, namely bandwidth, output sound pressure level, efficiency, etc. The dimensions of such an electrodynamic transducer are governed primarily by the first two criteria. In order to achieve acceptable performance, the height (h) of the rectangular system shown in FIG. 1 is given by $h=1/3.2\ (f_1)$ where $\lambda(f_1)$ is the wavelength of sound at the lowest operating frequency ($f_1$).

The width of the driven area $w_1$ is given by $w=\frac{1}{2}\lambda(f_2)$ where $\lambda(f_2)$ is the wavelength of sound at the highest operating frequency ($f_2$) and this relation arises from horizontal dispersion considerations. We recommend ignoring vertical dispersion in our dimensioning in order to give priority to achieving acceptable levels of sound output. For the type of unit described, with $f_1=300$ Hz, $f_2=10$ kHz then w=(approximately) h=50 cm, $w_1=1.5$ cm.

Figure 2:
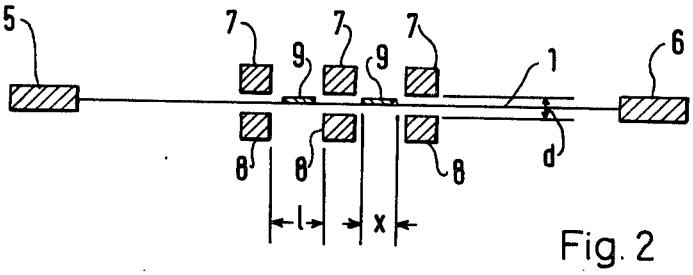
FIG. 2 shows the diaphragm in section of the line AA of FIG. 1 and on a distorted scale.

The arrangement of the electrodynamic motor required to drive the diaphragm of FIG. 1 is shown in FIG. 2. The diaphragm outer edges are clamped by frame members 5, 6. The arrangement of permanent magnets 7, 8 each side of the diaphragm 1, and current carrying conductors 9 is defined by the need to obtain as high a value of magnetic field as possible. Consistent with the need to allow enough motion of the diaphram 1 to produce acceptable acoustic output empirically, it is found that the distance l between the magnets is about 8mm. The width x of the conductor 9 is determined according to the value of l (8mm) and the radiating width at high frequencies ($w_1$). In the embodiment described this results in two adjacent tracks of conductor being required to be consistent with dispersion requirements. The distance between the adjacent faces of respective pairs of magnets 7 and 8 is d. Since the magnetic field strength at each conductor 9 is inversely related to a function of the form F(1)+F(d) reduction in the value of l or d will allow a more efficient unit to be constructed. With l approximately 8mm, it is found that as d is reduced significantly below 8mm towards 2–3mm efficiency improvements are at first substantial, then reduce. In practice a 3:1 ratio of l:d is adequate.

This spacing d defines the maximum peak to peak excursion of the diaphragm, which is a major factor in maximum intensity, particularly at low frequencies. It is also clear that to achieve a rated value of sound pressure level at the low frequency end of frequency range a minimum value of radiating area is required ($h \cdot w_2$). In practice we have found that this gives values of $w_2$ considerably greater than $w_1$ defined for dispersion requirements, typically $w_2 = 10$cm. In addition, as well-known for loudspeakers generally for uniform response down to $f_1$, the fundamental response of the diaphragm (f) should be less than or equal to $f_1$, and should preferably not be greater than $f_1$. At higher frequencies, the smaller areas and maximum peak excursions are needed to give the same intensity.

Figure 3:
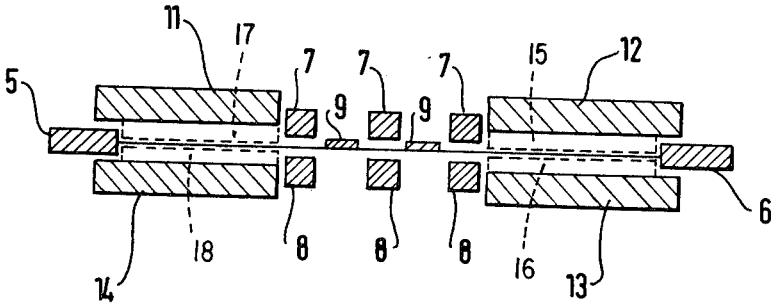
FIG. 3 shows in similar cross-section such a diaphragm, and baffles for the outer diaphragm sections of the invention.

These considerations lead to a unit similar to FIG. 3. At low frequencies (around $f_1$) the entire surface of the unit vibrates in phase. However the diaphragm is imperfect and at progressively higher frequencies through an intermediate frequency range, portions of the diaphragm vibrate in antiphase to the central driven area caused by reflections from the edge of the frame. This effect produces departures from flat frequency responses, e.g., cancellations or "suck outs" in the frequency response curve. At high frequencies however the diaphragm only vibrates close to the driven conductors in the centre. In order to control the frequency response in the intermediate frequency range four baffles 11–14 have been incorporated into the unit. These baffles both prevent radiation from the out of phase areas of the diaphragm and introduce a resistive acoustic damping to the diaphragm hence reducing the incidence and magnitude of maxima and minima in the frequency response curve.

The efficiency of such a unit is considered from both acoustic and electrical standpoints. The acoustic considerations have been outlined above. Electrical efficiencies can be improved by consideration of the force (F) equation. F=Bli where B is the value of magnetic field, l the length of conductor and i the current flow. The amplitude of vibration of the system depends on the driving force and inversely as the mass of the system. An analysis of its condition in this application has shown that a broad optimum occurs in the system. In particular the system possesses low impedance and therefore tends to carry high currents. The unit usually needs to be matched to its driving amplifier using a transformer. For a particular vertical dimension, a horizontal width of radiating area is chosen such that it is an optimum compromise between the wider (=more efficient) extreme, and the narrower (=more dispersive) extreme. This optimum width is frequency-dependent. To a reasonable approximation if the ratio (effective radiating width): (wavelength of sound) can be kept constant over the desired bandwidth then the efficiency and dispersion will also be constant.

Prior art publications propose differential driving of conductors at different frequencies. In contrast, here we are concerned with an alternative technique of using frequency-dependence in the mechanical coupling between a relatively narrow electrically-driven section and the wider diaphragm within which it is placed. The outer diaphragm portions can be made heavy and stiff except to bass frequencies. The dynamic equation of such a diaphragm can be written down in a simple form so that the treatment may be (mechanically) as a violin-string centrally excited and having damping and stiffness in addition to the mass and tension normally dominant in violin-string dynamics. The damping, stiffness and mass may be treated as variables along the length of the string, and the air-impedance terms added to the damping and mass terms where significant. Thus a relationship between the amplitude at x from the center o, and the various parameters, can be set down $$a_x/a_o = f(x, \text{mass, stiffness, tension, damping, frequency})$$

We have already implied by the above radiating width: wavelength ratio control that we wish to achieve $$\frac{\delta}{\delta x}\left(\frac{a_x}{a_o}\right) = \frac{1}{\text{frequency}}$$

and we can add another approximation, namely that the mass of the diaphragm should be high enough so that, outside the driven-and-coupled area, it baffles rather than being transparent to the radiated sound.

Thus we can mutually relate diaphragm mass (per unit area), stiffness, tension and damping as functions of x, for the optimum speaker performance, so that the effective radiating width, $b_{eff}$ relates to the sound wavelength, λ.

$$b_{eff} = k\,\lambda$$

over a desired bandwidth.

The opening for the speaker is slot shaped but of course the diaphragm is much greater in area than the slot, in accordance with the teachings of second aspect the invention. The technical effect of the slot-shaped aperture and baffles is completely different from the known loudspeakers having the diaphragm clamped all around a slot-shaped aperture. Baffles 11–14 may extend inwards right up to magnets 7 and 8, and they may confront the diaphragm also very closely. Even light contact with one or both sides of the diaphragm by two or all four baffles is permissible as indicated by dash lines 15, 16, 17, and 18, in FIG. 3. The maximum excursions of the diaphragm are at bass frequencies, and this must be allowed for in the design, for given bass power capacities typically the spacing from the diaphragm would be 0.5mm.

Another advantage is that due to the form of construction the large radiating area of the conductor reduces temperature rise of the conductor thus giving improved power dissipation. Overload of the unit such that the diaphragm strikes the magnet planes only causes distortion of the output sound, not impact damage or breakdown, as is liable in an electrostatic system. In practice the magnetic field falls away from the broad maximum around the centre line thus reducing the force experienced by the conductor.

In practice the diaphragm is constructed of Mylar or similar high temperature polymer film with a thickness of 5–10$\mu$. The conductor is attached by bonding. The conductor may be aluminum sheet approximately 10$\mu$ thick.

It should be noted that the relations between h, $w_1$, $w_2$, $f_1$ and $f_2$ mentioned earlier will be modified, usually advantageously, somewhat by the presence of the baffles. The above mentioned values of 10cm for $w_2$ and 1.5cm for $w_1$ show that the baffles together occupy about 85% of the total diaphragm area. We find the baffled diaphragm area should be from 52% to 91% or so, 80–85% being usually preferred.

The length h is quite decisive on the lower cutoff frequency $f_1$; baffles may change the final cutoff to 500 Hz from 255 Hz (see FIG. 4, a typical graph of $f_1$ against aperture length h. Length also affects sensitivity to low excitation powers at first, but with increasing lengths (e.g., exceeding 300 mm, see FIG. 5), very little more sensitivity results, the sensitivity plot becoming almost horizontal. Thus we recommend about 300 mm as adequate length to achieve sensitive response.

The situation with regard to width of aperture is less clear with regard to low frequency cutoff, since there are found to be so many other factors affecting low frequency performance. In the typically baffled unit, the width definitely limits the ultimate low frequency cutoff (obtainable by optimizing all other factors).

It should be noted that the general advantages of known electrodynamic loudspeakers continue to be available from those of the invention, generally speaking. The diaphragm stiffnesses and gradients thereof, mass per unit area, and damping will often have to be carefully considered, perhaps empirically, before the optimum performances and radiation patterns, freedom from intermediate frequency nulls etc. become fully realizable.

We claim:

1. An electrodynamic loudspeaker including a diaphragm having on at least one face thereof an electric current conductor arranged with spaced apart portions thereof extending parallel to one another over the major part of the length of the diaphragm, a permanent magnet arrangement spaced from the diaphragm and having elements extending parallel to the said portions along regions opposite to the spaces between the said conductor portions, the said conductor portions extending over a central area of the diaphragm only, a first pair of baffles arranged on one side of the diaphragm, each baffle covering a region of the diaphragm extending from a longitudinal edge of the diaphragm towards the central area, and a second pair of baffles arranged on the other side of the diaphragm, each of the second pair of baffles extending from a longitudinal edge of the diaphragm towards the central area, one pair of baffles being in contact with one side of the diaphragm.

2. A loudspeaker as claimed in claim 1 wherein the baffles cover between 52% to 91% of the area of the diaphragm.

3. A loudspeaker as claimed in claim 1 wherein the baffles extend up to the magnet arrangement.

* * * * *

UNITED STATES PATENT OFFICE

CERTIFICATE OF CORRECTION

Patent No. 4,156,801 Dated May 29, 1979

Inventor(s) Robert C. Whelan and Charles J. Sealey

It is certified that error appears in the above-identified patent and that said Letters Patent are hereby corrected as shown below:

Col. 1, line 32, "magnetic" is changed to -- magnet --.

Col. 2, line 65, "w=" is deleted.

Col. 3, line 6, "diaphram" is changed to -- diaphragm --.

Signed and Sealed this

*Twenty-first* Day of *August 1979*

[SEAL]

*Attest:*

*Attesting Officer*

LUTRELLE F. PARKER

*Acting Commissioner of Patents and Trademarks*